United States Patent [19]

Peter

[11] Patent Number: 4,864,268

[45] Date of Patent: Sep. 5, 1989

[54] PUSHBUTTON ACTUATED OVERLOAD PROTECTION SWITCH

[75] Inventor: Josef Peter, Altdorf, Fed. Rep. of Germany

[73] Assignee: Ellenberger & Poensgen GmbH, Altdorf, Fed. Rep. of Germany

[21] Appl. No.: 221,489

[22] Filed: Jul. 19, 1988

[30] Foreign Application Priority Data

Aug. 7, 1987 [DE] Fed. Rep. of Germany ... 8710812[U]

[51] Int. Cl.[4] ..... H01H 71/16

[52] U.S. Cl. ..... 337/70; 337/66; 337/62

[58] Field of Search ..... 337/66, 67, 68, 69, 337/70, 71, 72, 73, 74

[56] References Cited

U.S. PATENT DOCUMENTS 2,335,082 2/1943 Platz .

3,706,057 12/1972 Ellenberger .

FOREIGN PATENT DOCUMENTS 874171 4/1953 Fed. Rep. of Germany .

1020718 12/1957 Fed. Rep. of Germany .

2192729 4/1969 Fed. Rep. of Germany .

2123765 5/1972 Fed. Rep. of Germany .

*Primary Examiner*—H. Broome

*Attorney, Agent, or Firm*—Spencer & Frank

[57] ABSTRACT

A push-button actuated overload protection switch, particularly an on-board protection switch having instant ON switching as well as manual, thermal and/or electromagnetic tripping. The switch has various components such as a switch housing, a pushbutton and an associated spring, a contact bridge and a toggle lever device, a detent lever and a detent pawl, as well as two switch rods, these parts being interconnected to obtain the desired switching function.

19 Claims, 10 Drawing Sheets

PUSHBUTTON ACTUATED OVERLOAD PROTECTION SWITCH

BACKGROUND OF THE INVENTION

1. Field of the Invention

The invention relates to a pushbutton actuated overload protection switch, and in particular to an instant-on, manually, thermally and/or electromagnetically tripped onboard protection switch.

2. Brief Description of the Prior Art

An overload protection switch of the above noted type is known from German Patent No. 21 23 765. Its switch housing, comprising an upper and lower housing part, is penetrated by a switch rod having the pushbutton on its outer end and displaceably supported in the direction of pressure and acted upon by a pushbutton spring counter to the ON direction. A toggle lever, comprising two levers connected at their inner ends via a rotary slide joint, is disposed in the switch housing, between the switch rod and the contact bridge, and the contact bridge is embodied as a two-armed lever extending in the ON direction approximately at right angles to the displacement direction of the switch rod and joining the counterpart contact elements that are secured to the housing to one another. The first lever of the toggle lever, oriented toward the switch rod, is embodied as a bell crank and is supported pivotally and substantially displaceably in the direction of rotation of the switch rod in first grooves of the switch housing, by means of a bearing bolt disposed in the vicinity of the apex of the crank. With its free end, this first lever of the toggle lever is also braced, counter to the ON push direction of the switch rod, on a detent lever which is adjustable by a thermal and/or electromagnetic trip, such that the toggle lever can be spread apart into its stretched position from the ON push motion of the switch rod. In the ON position, the toggle lever is fixable in the housing by means of a detent pawl, with a substantially stretched toggle lever position. In the switch according to German Patent No. 21 23 765, this detent pawl is a one-armed lever supported on the side of the first lever of the toggle lever remote from the detent lever, and the one-armed lever, by the tension of an OFF spring fastened between it and the bell crank, latches in with the bearing bolt of the bell crank and fixes the bell crank in the ON position.

The second lever of the toggle lever, remote from the switch rod, carries the contact bridge on its free end, by means of a joint formed by a bolt; the bolt is guided in second grooves in the housing that extend in the push direction of the switch rod. These grooves have a detent that is operative counter to the push direction of the switch rod; at this detent, upon its forward motion into the ON position of the contact bridge, the bolt is supported briefly prior to attaining the ON position, before being pressed out of the detent, by the pivoting motion of the second lever which is associated with the further spreading motion of the toggle lever, and is pressed abruptly by a contact spring into the ON position of the contact bridge. The instantaneous switching ON of the switch latch is thereby assured.

The aforementioned OFF spring is secured with one end to the inner end of the first lever that protrudes beyond the joint of the toggle lever. At its other end, it is eccentrically supported on the detent pawl in such a manner that it urges the toggle lever in its buckling direction and hence in the OFF direction. The detent pawl itself is simultaneously pressed in the direction of its position that acts upon the bearing bolt for the first lever of the toggle lever.

The switch according to German Patent No. 21 23 765 is switched ON by the push actuation of the pushbutton and switched OFF by the pull actuation of the pushbutton. By pulling the switch rod counter to the spring force of the OFF spring, the detent pawl is pivoted out of its locking position, such that the first lever is yanked by the OFF spring in the opening direction of the switch latch. This causes the toggle lever to buckle inward and raises the contact bridge from the counterpart contacts attached to the housing.

Push-pull actuation is disadvantageous from the standpoint of ease of use and safety, because two different actuation directions are required for switching it ON and OFF. For rapid switching OFF, push actuation of the switch would be desirable as well, because in that case the pushbutton need not be awkwardly grasped first.

Accordingly, it is the object of the present invention to further develop the overload protection switch according to the prior art in such a way that it is switched both ON and OFF by a push actuation of the pushbutton. ton.

SUMMARY OF THE INVENTION

For the push-push actuation of the switch latch, two switch rods are used, each of which is assigned different functions: The first switch rod, known from the prior art, is assigned the function of switching ON, while the second switch rod according to the invention is now responsible for switching OFF. To render this switch rod inoperative in the ON push motion, a guide lever pivotally supported on the first lever of the toggle lever is provided. With its free end, the guide lever latches together with the inner end of the second switch rod and, driven by the spreading motion of the first lever of the toggle lever, pivots the second switch rod out of the position of engagement of its dog with the trip lever arm of the detent lever into its release position. The second switch rod thus moves past this trip lever arm in the course of the ON push motion.

A further advantage of the overload protection switch according to the invention is the fact that only the locking engagement between the detent lever and the free arm of the first lever, embodied as a bell crank, of the toggle lever is now responsible for the actual tripping. Although the fixing of the switch latch in the ON position is effected by the support lever according to the invention, which is braced on a counterpart bearing attached to the housing, nevertheless the toggle lever is released by the release of the locking engagement between the detent lever and the bell crank, regardless of whether this is dictated by thermal, electromagnetic or manual tripping.

Quite generally, the push-push, i.e., push ON, push OFF, actuation and thus the great ease and safety of use are attained by means of a switch latch construction that is in no way more expensive than the switch of the prior art. In either case, instant ON and OFF switching independently of the hand is assured. Advantageous further features of the overload protection switch according to the invention are disclosed in the dependent claims.

A further feature has the advantage that no additional bearing elements are used for supporting the guide and support lever; instead, the bearing bolt that is already present for support the first lever of the toggle lever is used for this purpose By means of another feature, despite the doubling in number of the switch rods as compared with the switch of the prior art, no additional space is required, because the two flat steel bars bent in a L shape nest one within the other. A stable, sturdy connection between the pushbutton and the switch rods is obtained because of the shape of the switch rods and of the recess in the pushbutton. Because of their parallel contact with one another, the two switch rods guide one another, which has a favorable effect on the switching performance of the switch latch.

A further teaching creates a particularly compact structural unit on the pushbutton side of the switch lock. That is, the two switch rods and the pushbutton spring are located substantially parallel to one another, and the pushbutton spring, with its diameter, occupies the space transverse to the push direction that is intrinsically available in this direction, because of the extension of area of the two horizontal L legs of the switch rods.

According to a yet further feature vertical L leg of the second switch rod has a width that decreases continuously with increasing distance from the horizontal L leg. This assures the pivotability of the second switch rod in a plane parallel to the pivot plane of the toggle lever inside the pushbutton recess. At the same time, the two long side edges of the vertical L leg serve as pivot stops for the pivot motion of the second switch rod.

According to a further feature, the second switch rod is continuously subjected to a pivot spring action by the pushbutton spring in the direction of its engagement position. In the event that the second switch rod is not latched to the guide lever, it assumes its engagement position at any time and reliably; in this position, its dog comes into contact, in the ON push motion, with the trip lever arm of the detent lever. Accordingly, the pushbutton spring performs a double function, first providing for the return of the pushbutton with the two switch rods to its intermediate ON or OFF position, respectively, and secondly it assures that the spring will urge the second switch rod into its engagement position.

According to a yet further feature, the existing detent lever needs only to be supplemented with a trip lever arm, in order to support the bell crank of the toggle lever and enable the switching OFF of the switch by pressure. Accordingly the very expensive, independently pivotally supported detent pawl, such as is present in the switch of, the prior art described, becomes unnecessary.

A still further feature discloses a simple structure for the embodiment of the dog on the second switch rod. The switch rod, substantially just like the first switch rod, comprises a flexible metal stamped part, which is very simple to produce. Because the dog is disposed approximately at a right angle to the extension plane of the vertical L leg, the dog has a greater length compared with the thickness of the second switch rod. This assures at all times that the dog, in the engagement position of the second switch rod, will engage the trip lever arm of the detent lever, and in the push motion for switching OFF will assure that the detent engagement between the detent lever and the first lever of the toggle lever will be released.

With an embodiment of the second switch rod in combination with the arrangement of the horizontal L leg favorable lever ratios are obtained in the deflection of the second switch rod out of its engagement position into the release position. Thus the forces that are to be brought to bear in the push motion for switching the switch ON are substantially not increased in comparison with switches of the prior art.

According to a further feature, in a particularly simple structural manner, the pivot motion of the first lever of the toggle lever in its stretching direction is transmitted via the two-armed guide lever onto the second switch rod, to pivot it out of the engagement position into the release position. The drive protrusion of the first lever of the toggle lever may simply comprise a laterally protruding bolt, which engages the free end of the lever arm of the guide lever oriented toward the contact bridge and carries it with it in its pivoting motion.

Since the guide lever is embodied as a T-shaped lever it is possible in a structurally simple and elegant manner to put the lever, in the OFF position of the switch latch, into a defined outset position with respect to the latching with the second switch rod. To this end, a guide face that is at a tangent on the outside to the horizontal T leg of the guide lever is disposed in the housing. This assures that the switch can be reliably switched ON at any time, since the second switch rod in each case latches with the guide lever, and its dog is moved past the trip lever arm of the detent lever in the ON push motion.

With the structure of the support lever, comprising two plates joined at their free ends by a bolt, the support lever becomes particularly sturdy and assures a reliable fixing of the switch latch in the ON position. There are in fact two support points, which additionally prevents tilting of the support lever transversely to the pivot plane of the toggle lever. As a result, the switch latch as supported is reliably protected against tilting and against any possible jamming of the individual components that would cause a malfunction.

In order to assure a reliable attainment of the support of the support lever on the counterpart bearing during the switching ON push motion, the support lever is pivotally urged toward the counterpart lever, at least during the switching ON push motion.

This pivot action can be effected in various ways such as by a diamond-shaped opening, penetrated by the bolt of the support lever, in the vertical L leg of the first switch rod effect this pivot action. The opening has two opposed peripheral edges extending parallel to the push direction and an upper peripheral edge inclined with respect to the counterpart bearing of the support lever. This inclined edge, in the switching ON push motion, pivots the bolt of the support lever toward the counterpart bearing. It also provides for transmission of the switching on push motion of the first switch rod, via the support lever, to the bearing bolt of the first lever of the toggle lever. The longitudinal extension o the opening in the push direction enables a recoil of the pushbutton and the two switch rods upon attaining the lowermost push position of the pushbutton, by which means the latching between the guide lever and the second switch rod is releasable. This also defines the push path for the switching OFF push motion. The position of the pushbutton after attaining the ON position is defined by the lower peripheral edge of the opening, which is supported on the bolt of the support lever, after the support lever latches with the counterpart bearing attached to the housing. The inclination of the lower edge in a direction remote from the counterpart bearing has the further advantage that if the switch is improperly used, namely if the pushbutton is pulled to turn the switch off, tripping of the switch latch is again possible. That is, the support lever is pushed away from the counterpart bearing by the lower edge, which takes away its support and releases the switch latch. Accordingly, tripping of the switch is possible even with incorrect use; moreover, damage to the switch latch is thereby avoided.

In an alternative embodiment, the pivot action on the support lever in the direction toward the counterpart bearing is accomplished by a torsion spring supported on the bearing bolt of the first lever of the toggle lever and supported with its legs on the bolt of the support lever or on a protrusion of the lever. The urging of the first lever of the toggle lever in the switching ON push direction no longer takes place via the support lever but rather directly by means of an inclined bearing edge inclined toward the detent lever and disposed in the vicinity of the inner end of the first switch rod on its end face. By means of the incline, the bearing bolt and thus the first lever of the toggle lever are guided inside the guide grooves of the toggle lever, on the edge of the grooves oriented toward the detent lever. Thus the locking of the first lever of the toggle lever to the detent lever is always the same from one switching cycle to another and does not differ from one side to the other. This situation is very important for the sake of a narrow range of deviation of the response curve of the switch.

There is also provided a structurally simple development of the counterpart bearing, attached to the housing, for the support lever. Since unlike the switch of the prior art the counterpart bearing no longer needs to be movable to attain manual tripping of the switch latch, it may be embodied as a simple plate, disposed with its plane at right angles to the push direction.

This plate may have an opening which provides a means for possible fixing of the end of the switching OFF spring attached to the housing. Additionally, the counterpart bearing plate may be used as an additional guide element for the first switch rod.

BRIEF DESCRIPTION OF THE DRAWINGS

The invention will be described in further detail in terms of two exemplary embodiments, in conjunction with the accompanying drawings.

DESCRIPTION OF THE PREFERRED EMBODIMENTS

Figure 1:
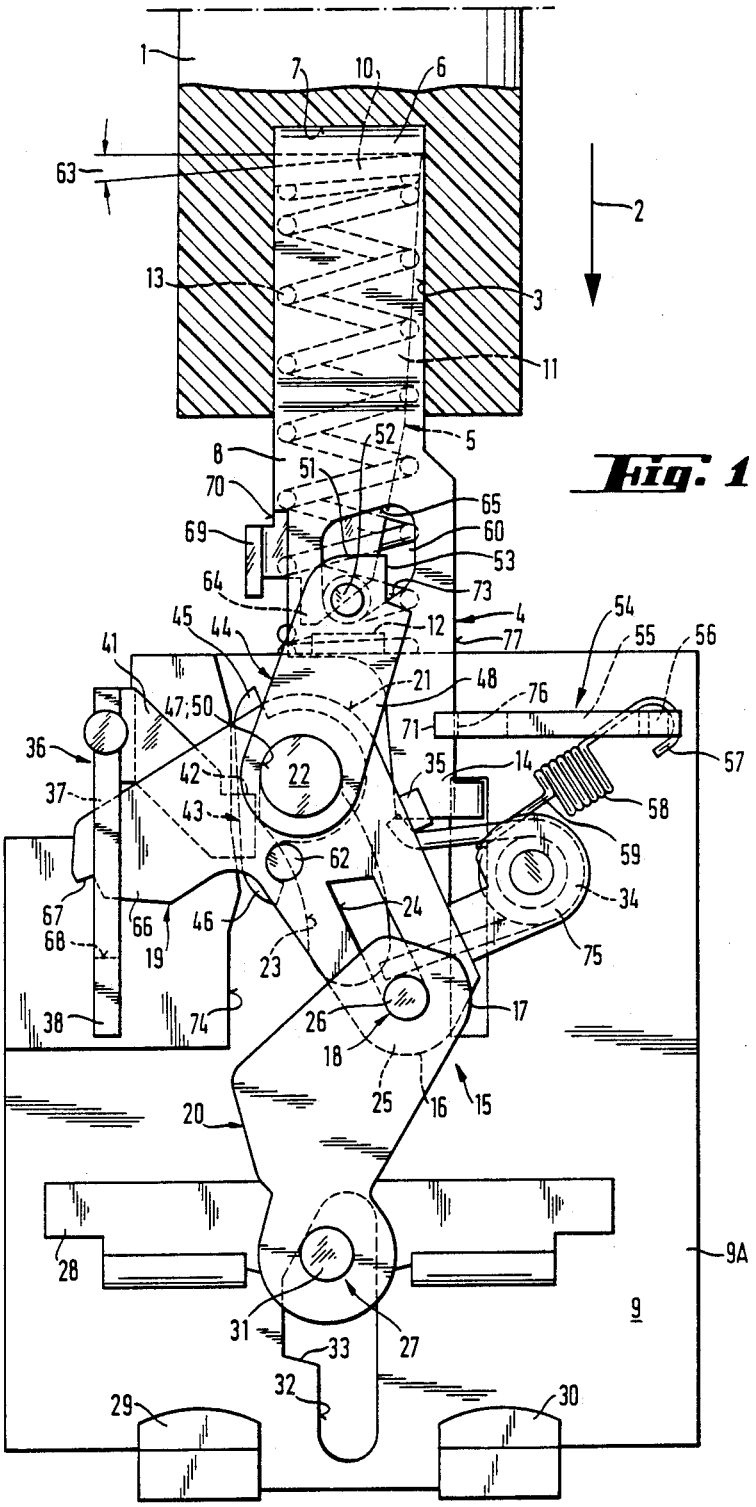
FIGS. 1–4 are schematic side views of the switch latch of overload protection switch, in a first exemplary embodiment, in various switching positions.
Figure 2:
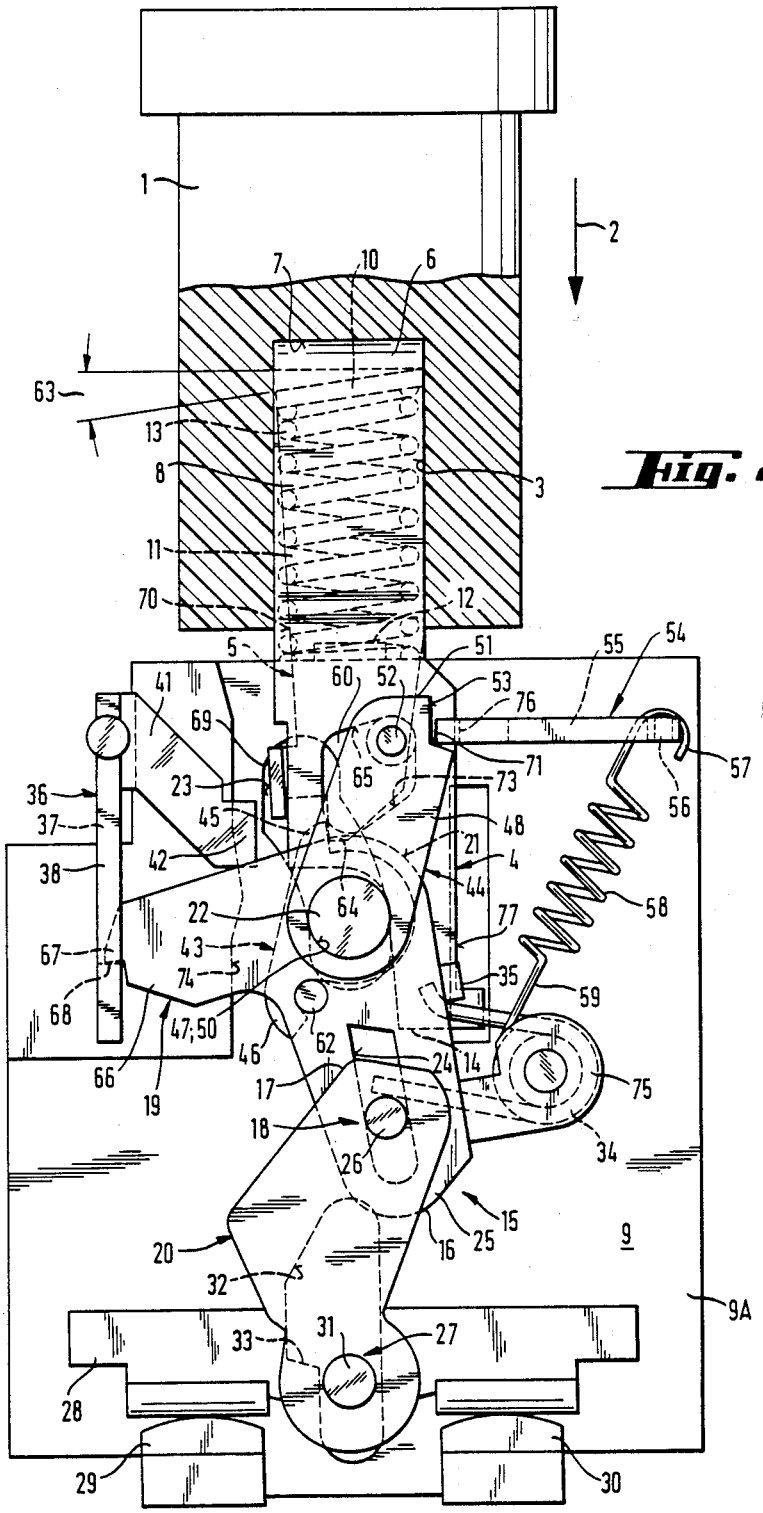

The overload protection switches shown in two slightly different exemplary embodiments in the drawings are improvements to the switch disclosed in German Patent No. 21 23 765. For the sake of simplicity, substantially identical components of the subject of the invention and of the overload protection switch according to this prior art (among others, the housing and the thermal trip) have been omitted from the drawings. In particular, the subject of the invention likewise has a two-part housing that is divided into two partial chambers by a partition. The thermal and/or electromagnetic trip device, which via a detent lever spanning the partition acts upon the locking of this lever with the switch latch, is disposed in one of these chambers. For further description, see the aforementioned patent.

Figure 5:
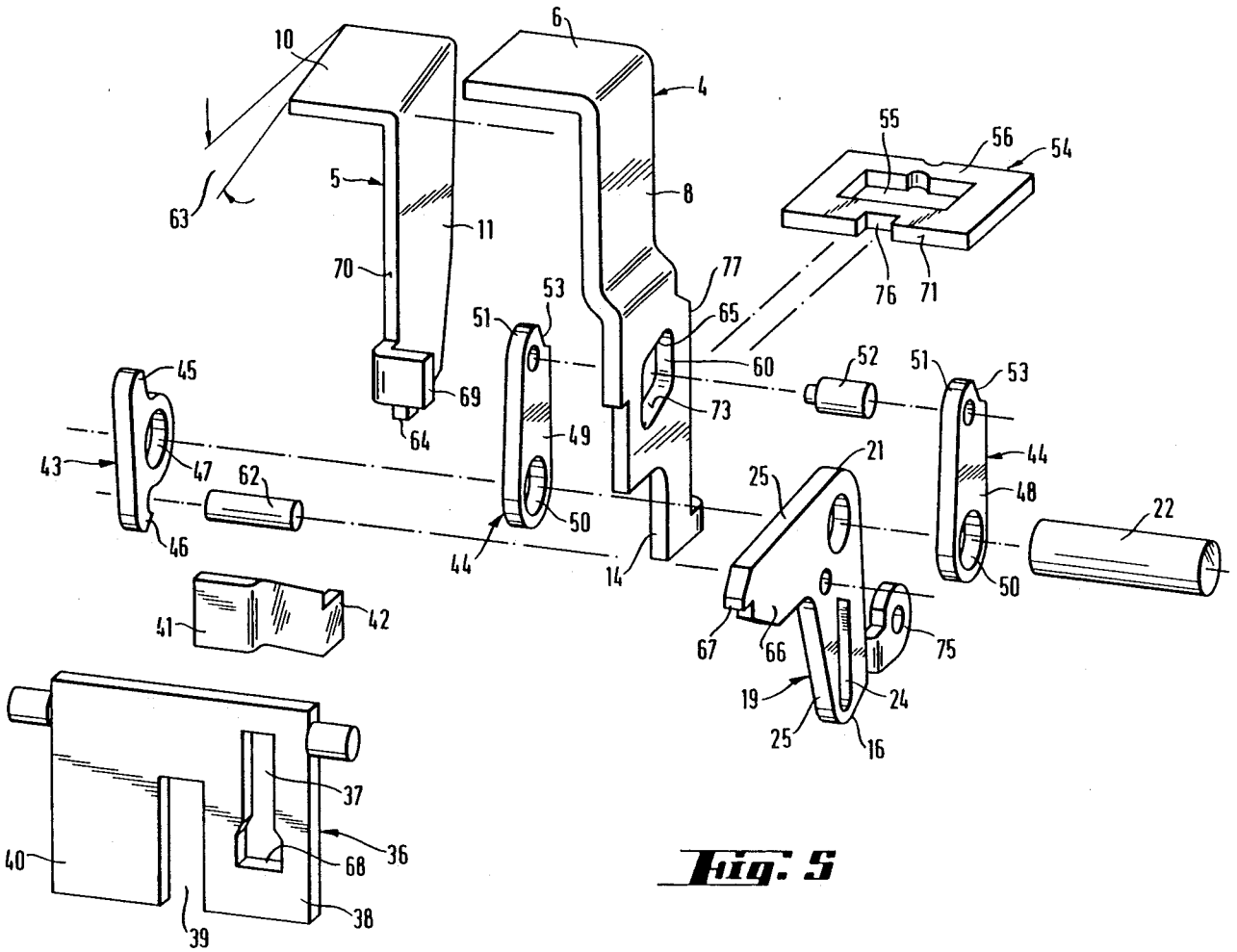
FIG. 5 is an exploded view of this switch latch.
Figure 10:
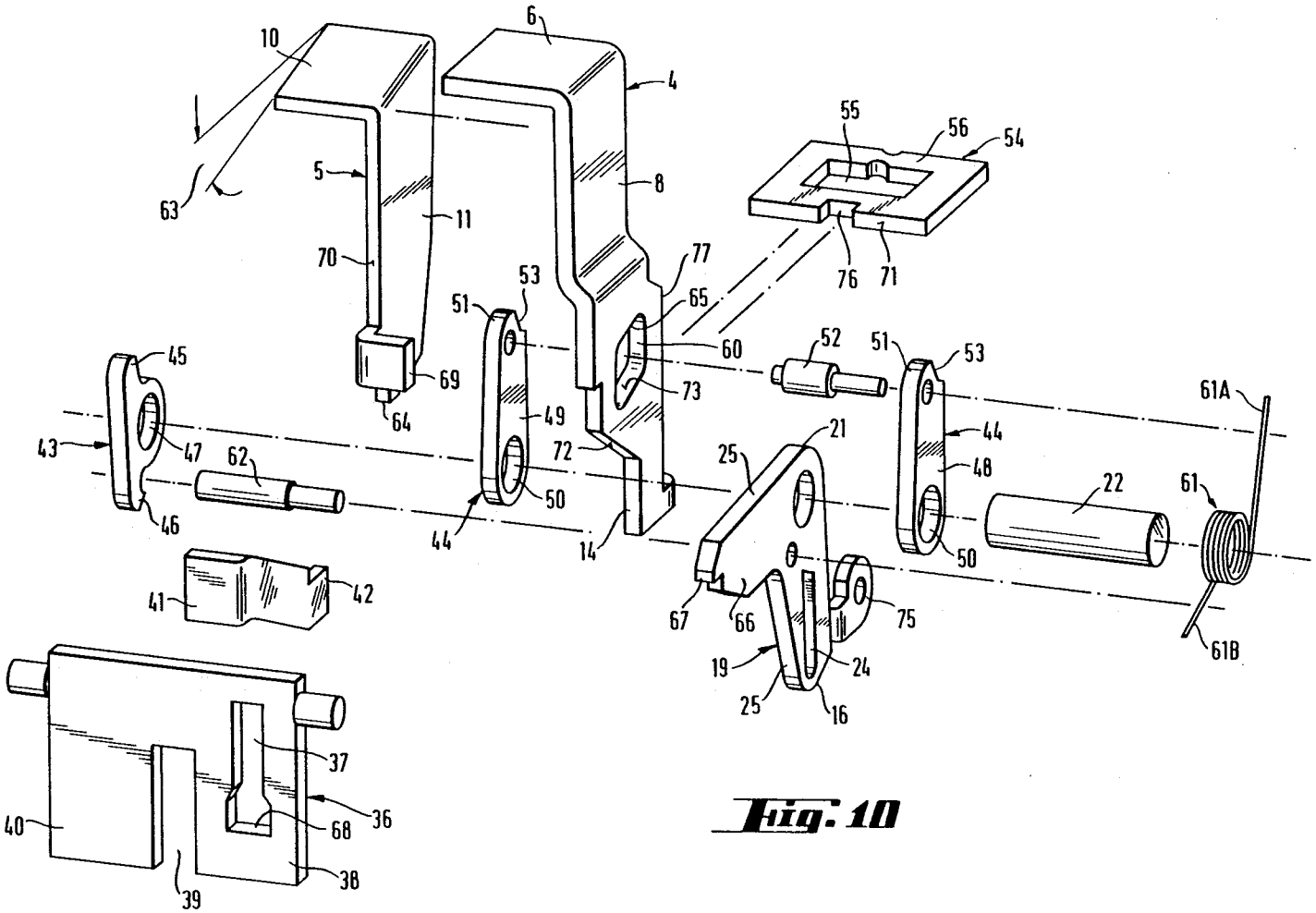
FIG. 10 is an exploded view of the switch latch of FIGS. 6–9.

The overload protection switch according to the invention has as its actuating device a substantially cylindrically shaped pushbutton (1), which is displaceably guided in the push direction (2) in a housing opening (not shown). Beginning at its end face pointing into the interior of the housing, the pushbutton (1) is penetrated coaxially by a rectangular-block-shaped, blind-bore-like recess (3) that likewise extends in the push direction (2). Two switch rods engage the inside of this recess (3), which as shown particularly in FIGS. 5, 10 are each embodied by a flat steel bar bent in an L shape in longitudinal section. The two switch rods (4, 5) are located in one another, flanking one another and parallel. For the sake of simplicity, the outer switch rod (4) will hereinafter be called the switching 0N rod (4), and the switch rod (5) located therein will be called the switching OFF rod (5). The switching ON rod (4) is located more or less standing on its head, with its horizontal L leg (6) on the bottom (7) of the recess (3), where it is fixed by being riveted or glued or the like. Its vertical L leg (8) protrudes into the housing chamber (9) formed by the partition (9A). The switching OFF rod (5), with its horizontal L leg (10) or vertical L leg (11), flanks the two corresponding legs (6, 8) of the switching ON rod (4). The mutual contact of the switch rods (4, 5) is maintained by the pushbutton spring (13) likewise extending in the recess (3) and fastened in place between the housing tang (12) and the horizontal L legs (6, 10) of the two switch rods (4, 5). Naturally, the pushbutton spring (13) also urges the pushbutton (1) counter to the push direction (2). The pushbutton spring (13) is a helical spring.

The switching ON rod (4) is connected with its end (14) inside the housing with the toggle lever (15). This toggle lever comprises two levers (19, 20) joined at their inner ends (16, 17) via a rotary slide joint (18) The first lever (19) of the toggle lever (15) oriented toward the switching ON rod is embodied as a bell crank and is supported by means of a bearing bolt (22) disposed in the vicinity of its crank apex (21) such that it is supported both pivotally, in grooves (23), extending substantially in the push direction (2) in the side wall or partition (9A) of the switch housing, and displaceably in the push direction (2). The rotary slide joint (18) between the two levers (19, 20) is embodied by the slit (24) on the toggle lever arm (25) of the lever (19) and the bolt (26), engaging the inside of the slit, on the second lever (20). By means of a joint (27), the second lever, on its end remote from the pushbutton (1), supports the contact bridge (28), embodied as a two-armed lever, which in the 0N position of the switch spans the counterpart contacts (29, 30) attached to the housing. The joint (27) is embodied by a bolt (31), which is guided, laterally extended in grooves (32) that extend in the push direction (2), in the housing wall or partition (9A). The groove 32 has a detent (33), which—as described in detail in German Patent No. 21 23 765—serves to provide an instant ON feature, by housing stops, not shown, and well as with a torsion spring on the rotary slide joint (18). Since the toggle lever and contact bridge construction have no substantial differences from the overload protection switch of the prior art, further description of these elements will be omitted here.

The contact compression spring (34) embodied as a torsion spring is supported on a protrusion (75) of the lever (19) disposed beside the slit (24). The two legs of this spring (34) are supported on a protrusion (35), located approximately in the middle of the toggle lever arm (25) of the lever (19), and on the bolt (26) of the rotary slide joint (18), respectively. As a result, the second lever (20) of the toggle lever (15) is urged by spring action in the 0N direction.

The detent lever (36) is pivotally supported in the housing laterally beside the lever (19). As clearly shown in FIGS. 5 and 10, the detent lever (36) is embodied as a U-shaped plate. The locking arm (38), provided with a slit (37) extending in the push direction (2) and embodied by a U leg, is located in the interior (9) of the housing of the switch latch shown in FIGS. 1–4 and 6–9. The partition (9A) between the two housing chambers (one not shown, the other identified by reference numeral (9)) extends in the recess (39) formed between the two legs of the U. The urging arm (40), which may be urged by the thermal and/or electromagnetic trip device of the switch, is located in the second housing chamber, which is equipped with the thermal and/or electromagnetic trip device. The trip lever arm (41) is secured to the locking arm (38), at an acute angle and in a plane parallel to the pivot plane of the toggle lever (15), pointing in the direction toward this toggle lever. The trip lever arm protrudes with its free end (42) into the displacement path of the switching OFF rod (5).

The T-shaped guide lever (43) and the one-armed support lever (44) are additionally pivotally supported on the bearing bolt (22) of the lever (19). The horizontal leg of the T of the guide lever (43) forms its two lever arms (45, 46). The vertical leg of the T forms the bearing bore (47) for the pivot bearing of the guide lever (43) on the bearing bolt (22).

The support lever (44) is embodied by the two elongated-oval-shaped plates (48, 49), which are disposed approximately parallel to the push direction (2). On their end oriented toward the contact bridge (28), the two plates (48, 49) each have respective aligned bearing bores (50) for the pivot bearing of the support lever (44 on the bearing bolt (22). They are disposed on both sides of the lever (19) or of the switching ON rod (4). At their free ends (51), the two plates (48, 49) are firmly joined by the bolt (52). The free ends (51) also have notches (53) on their sides remote from the detent lever (36), and by means of these notches the support lever (44) can be supported on a counterpart bearing attached to the housing in the ON position of the switch latch. The counterpart bearing attached to the housing is embodied by the rectangular counterpart bearing plate 54, disposed with its plane at right angles to the push direction 2. This plate 54 has a likewise rectangular central opening (55), thus embodying the counterpart bearing plate (54) in the manner of a frame. On the strut (56) of the frame remote from the switch latch, one hanger eye (57) of the OFF spring (58), disposed laterally beside the switch latch, is fixed. The second hanger eye (59) acts upon the upper leg, supported on the protrusion (35) on the lever (19), of the contact compression spring (34). The counterpart bearing plate (54) also has a rectangular recess (76) on its edge (71), in which recess the long side edge (77) of the switching rod (4) oriented toward it is guided in the push direction (2).

The bolt (52) between the two plates (48, 49) extends through diamond-shaped opening (60) in the vicinity of the end (14) inside the housing of the switching ON rod (4).

In the exemplary embodiment of FIGS. 6–10, an additional torsion spring (61) is seated on the bearing bolt (22) of the lever (19), being supported with its two legs (61A, 61B) on the bolt (52) of the support lever (44) and on a lateral pin (62) on the lever (19), respectively.

Figure 6:
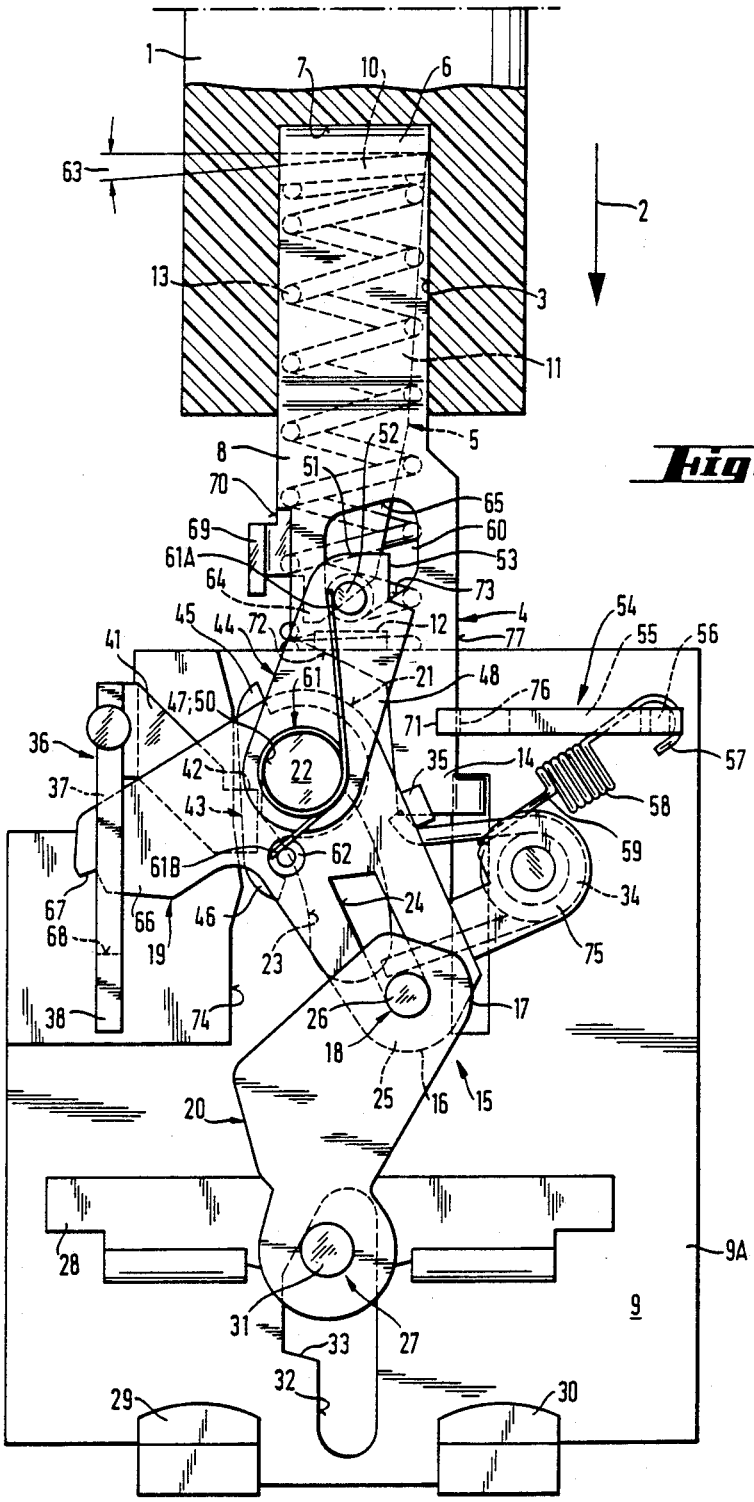
FIGS. 6–9 are schematic side views of the switch latch in an alternative embodiment in various switching positions.
Figure 7:
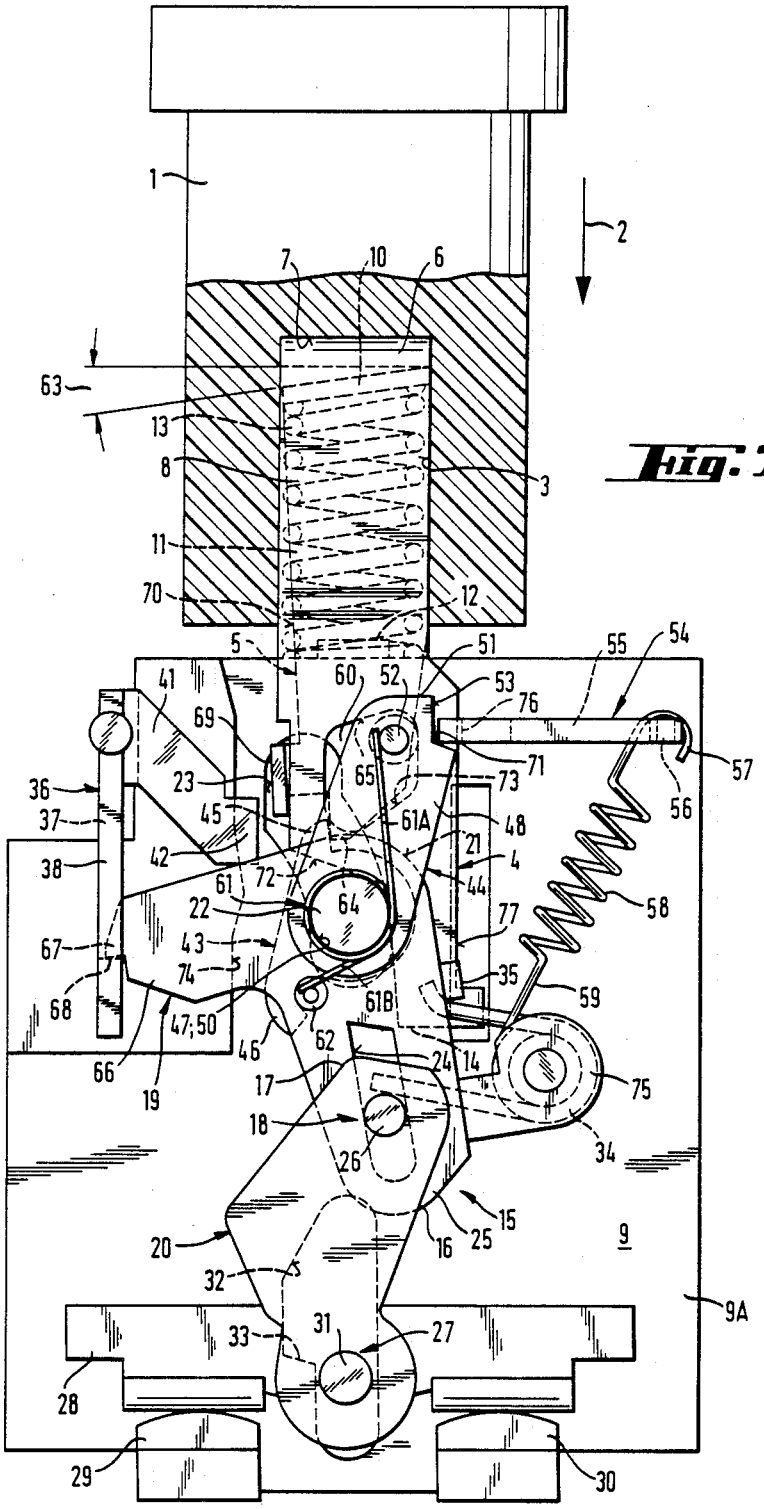

The mode of operation of the two types of switch will now be described in further detail:

In FIGS. 1 and 6, the switch is shown in its OFF position. Since the horizontal L leg (10) of the switching OFF rod (5) is disposed with its plane of extension at a small acute angle (63), opening toward the side of the detent lever (36), the switching OFF rod (5) is urged by the pushbutton spring (13) in a clockwise pivoting direction as seen in the drawings. In FIGS. 1 and 6, the switching OFF rod (5) occupies its engagement position. If the pushbutton (1) is depressed in the push direction (2), then the two switch rods (4, 5) are moved toward the housing interior, counter to the pressure of the pushbutton spring (13). The bolt (52) of the support lever (44) passe through the opening (60) in the switching ON rod (4). In an intermediate position, not shown, the free end of the vertical L leg (11) of the switching OFF rod (5), embodied as a latching protrusion (64) tapering at an acute angle, latches with the upper lever arm (45) of the guide lever (43).

In the exemplary embodiment of FIG. 1–5, the bolt (52) of the support lever (44) simultaneously reaches the upper edge (65), inclined toward the counterpart bearing plate (54), of the opening (60) in the switching ON rod (4). Upon further depression, the support lever (44) is pivoted clockwise as seen in the drawings, and at the same time the upper lever (19) of the toggle lever (15) is displaced in the push direction (2). Since its free arm (66) is supported with its detent end (67) on the detent (68), embodied by the slit (37) of the detent lever (36), the lever (19) is pivoted about this detent, and the toggle lever (15) is guided into the stretched position, with displacement of its lower lever (20).

In the exemplary embodiment of FIG. 6–10, an oblique bearing edge (72) cooperating with the bearing bolt (22) of the lever (19) of the toggle lever (15) is disposed on the end (14) of the switching ON rod (4) inside the housing; this edge (72) transmits the switching ON push motion of the pushbutton (1) to the bearing bolt (22). In this process, the bolt (52) of the support lever (44) does not come into contact with the upper edge (65) of the opening (60). In this embodiment, the urging of the support lever (44) in the clockwise direction is effected by the torsion spring (61).

As described in detail in German Patent No. 21 23 765, in both exemplary embodiments the bolt (31) on the contact bridge (28) reaches the detent (33) and thus is stopped shortly before reaching the ON position, until it slides away from the detent (33) by a pivoting of the lower lever (20), and the contact bridge (28) abruptly moves into the 0N position.

By the pivoting of the upper lever (19), its pin (62) comes into contact with the lower lever arm (46) of the guide lever (43), thereby likewise pivoting this guide lever clockwise. Since the other lever arm (45) is latched to the latching protrusion (64) on the switching OFF rod (5), the switching OFF rod is pivoted out of its engagement position 10 (FIGS. 1–6) into the release position shown in FIGS. 2, 7. The pivoting inside the recess (3) is possible because the vertical L leg (11) of the switching OFF rod (5) narrows down in width with increasing distance from its horizontal L leg (10). In the release position, the dog (69) on the switching OFF rod (5) moves past the free end (42) of the trip lever arm (41) of the detent lever (36). The dog (69) is disposed in the vicinity of the free end of the vertical L leg (11) of the switching OFF rod (5), on the long side edge (70) oriented toward the detent lever (36), and is embodied as a bending tab bent approximately at right angles to the extension plane of this vertical L leg (11).

Upon attaining the extreme depressed position (FIGS. 2, 7) of the switch latch, the support lever (44), with its notches (53), engages the edge (71) of the counterpart bearing plate (54) oriented toward the switch rods (4, 5) from behind. The switching OFF spring (58) is stressed by the stretching motion of the toggle lever (15).

Figure 3:
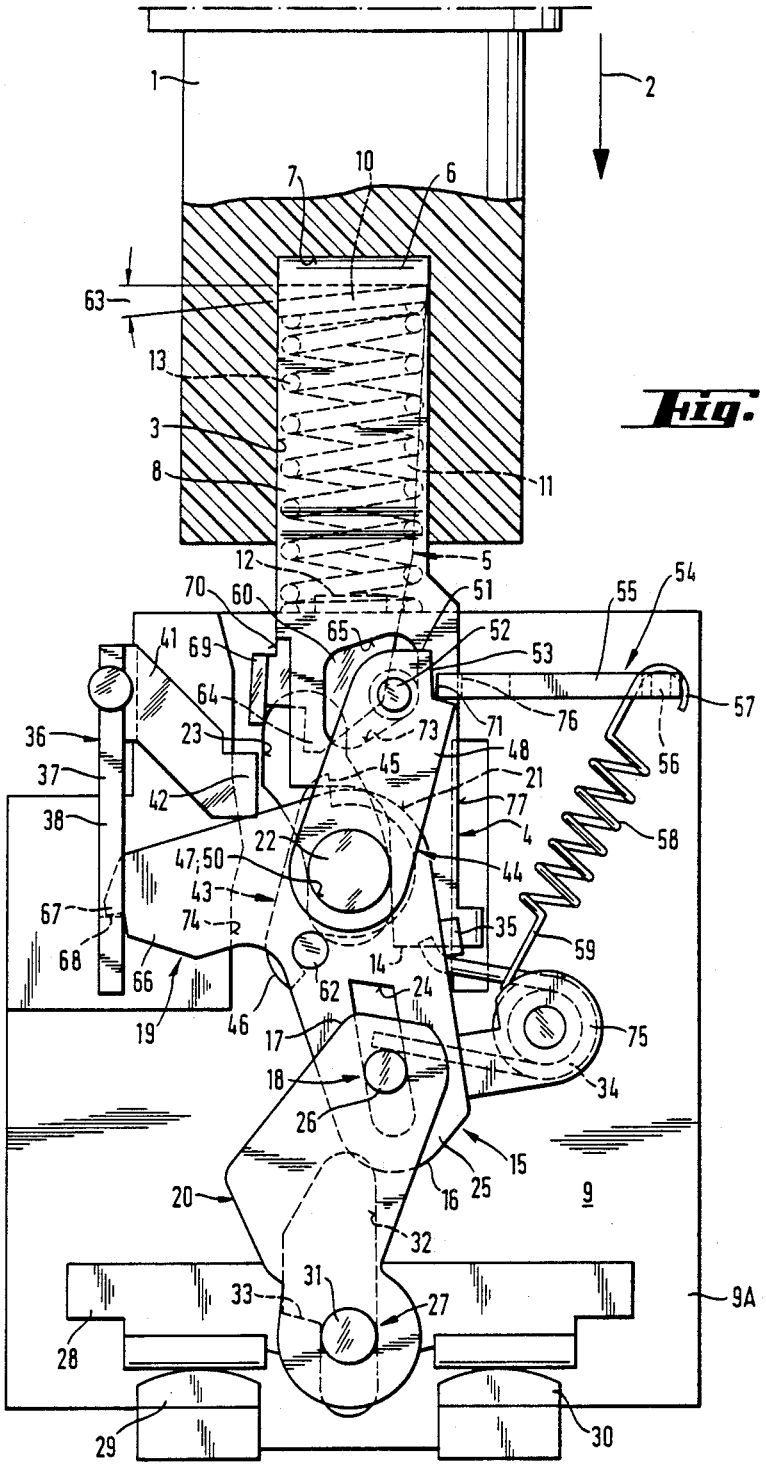
Figure 4:
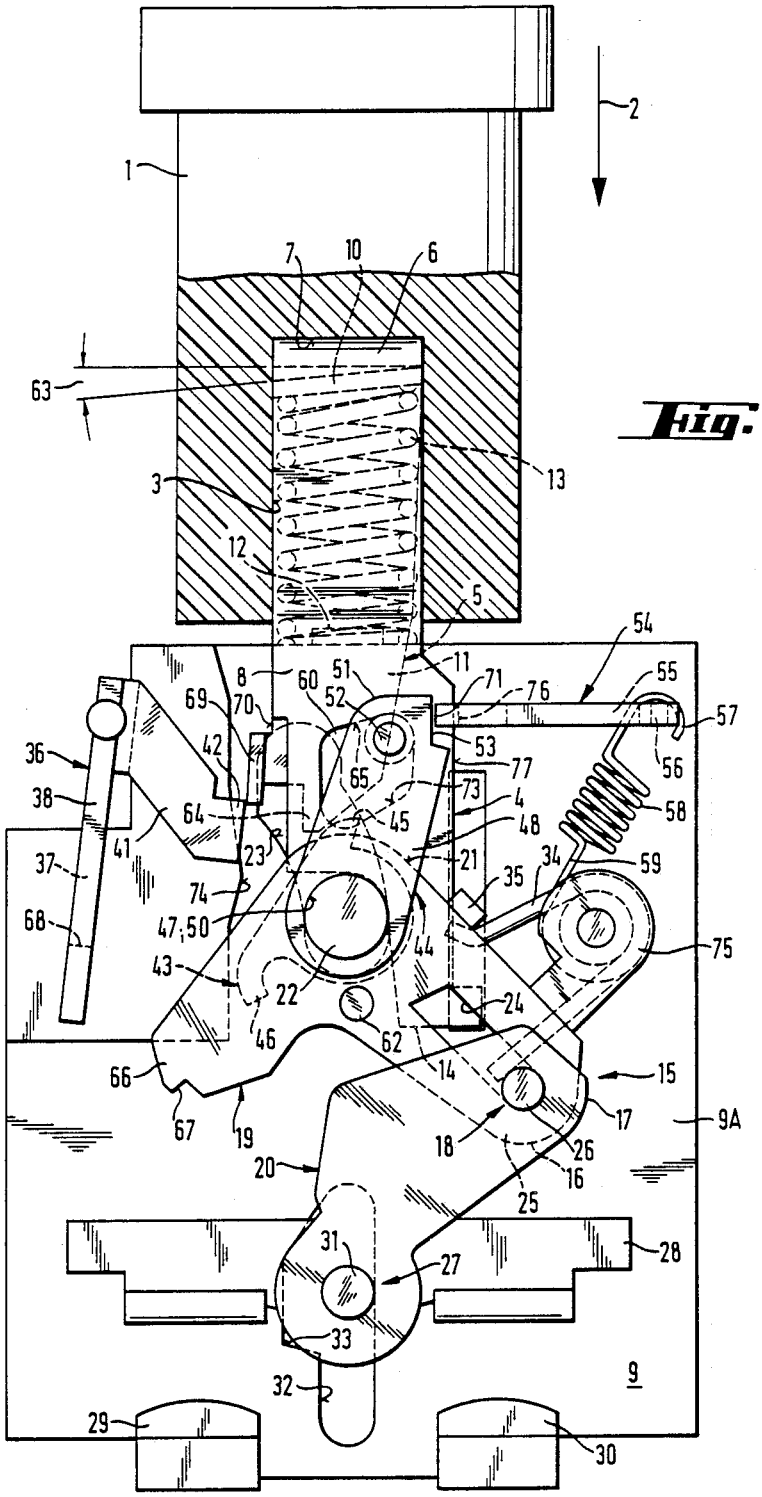
Figure 8:
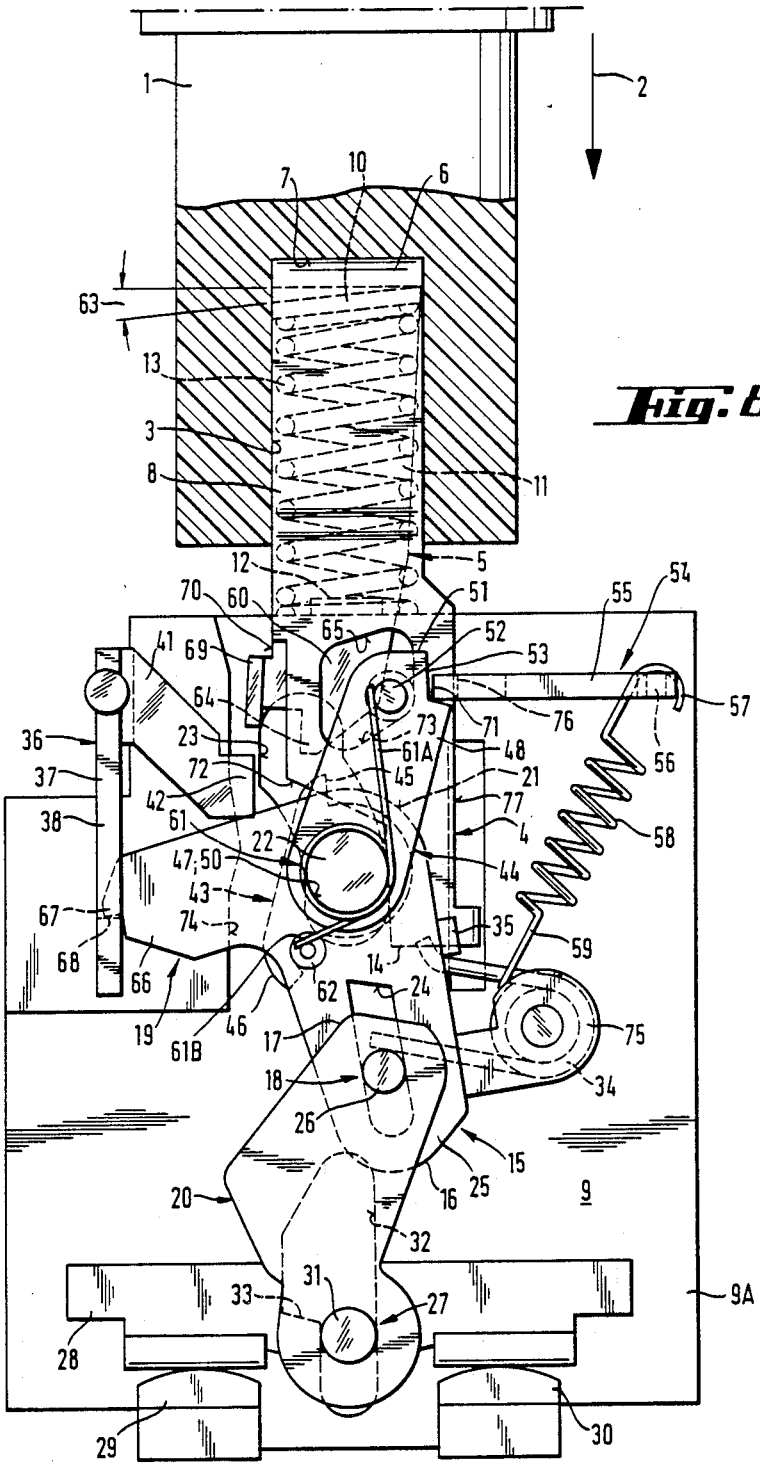
Figure 9:
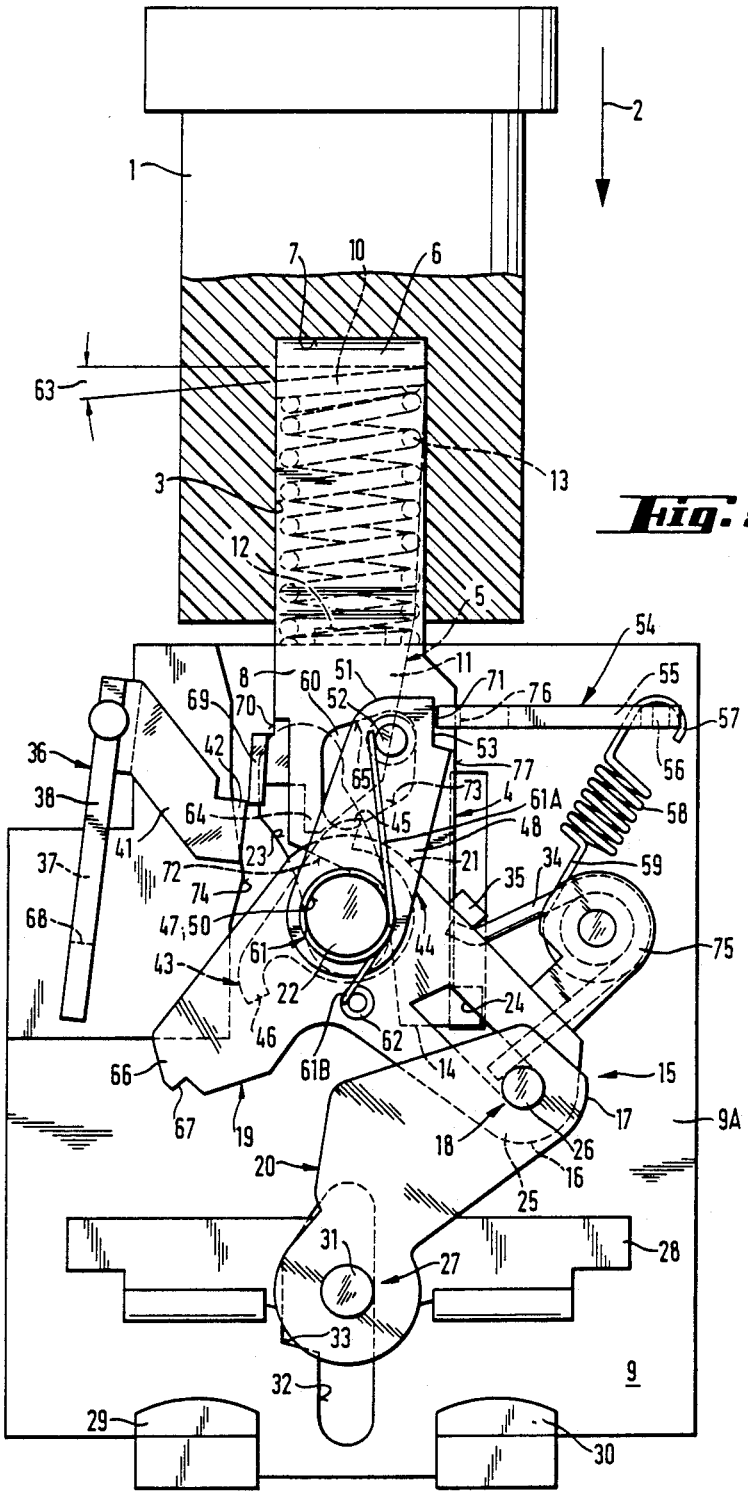

In FIGS. 3 and 8, the switch is shown in its 0N position, which is assumed upon attainment of the extreme depressed position upon the release of the pushbutton. The pushbutton (1) and the two switch rods (4, 5) are here displaced counter to the push direction (2), under the influence of the push button spring (13), until the lower edge (73), oriented away from the counterpart bearing plate (54) of the opening (60) comes to a stop on the bolt (52) of the support lever (44). This stop limits the recoiling motion of the pushbutton (1) and switch rods (4, 5). However, the recoiling motion is great enough that the latching between the latching protrusion (64) of the switching OFF rod (5) and the upper lever arm (45) of the guide lever (43) is released. Under the influence of the pushbutton spring (13), the switching OFF rod (5) pivots back into its engagement position. The switch latch, fixed in the 0N position by the support lever (44), is now ready to be tripped.

In the case of thermal or electromagnetic tripping, the corresponding tripping device (not shown) acts upon the urging arm (40) of the detent lever (36) in the clockwise direction as seen in the drawings. This pivots the detent lever (36) in this direction as well and releases the latching between the detent end (67) of the lever (19) and the detent (68). Under the influence of the switching OFF spring (58), the toggle lever (15) is jerked into its buckling position, and the contact bridge (28) lifts away from the counterpart contacts (29, 30) attached to the housing.

Manual tripping is effected by pushing the pushbutton (1). In the switching OFF push motion, no latching of the latching protrusion (64) of the switching OFF rod (5) with the guide lever (43) occurs, because these two components move substantially past one another; that is, the upper lever arm (45) slides off on the back of the latching protrusion (64). Accordingly, the dog (69) engages the free end (42) of the trip lever arm (41), causing the clockwise pivoting of the detent lever (36) as well. Precisely as in the case of thermal tripping, the latching between the detent (36) and the lever (19) of the toggle lever (15) is released, causing buckling in of the toggle lever (15) and lifting of the contact bridge (28) from the counterpart contacts (29, 30).

When the pushbutton (1) is then released, the lower edge (73) comes into contact with the bolt (52) of the support lever (44), pivoting the support lever counterclockwise about the bearing bolt (22). The notches (53) move past the counterpart bearing plate (54), causing the entire switch latch to be moved back into the initial position shown in FIGS. 1, 4. By means of the guide face (74) attached to the housing and extending substantially in the push direction (2) laterally beside the guide lever (43), the guide lever (43) is pivoted counterclockwise, out of the pivoted position shown in FIGS. 4 and 9 back into the initial position shown in FIGS. 1, 6, by the action on the two lever arms (45, 46) by means of the guide face (74).

I claim:

1. A pushbutton actuated overload protection switch, in particular an on-board protection switch having instant ON switching as well as manual, thermal and/or electromagnetic tripping, comprising (a) a switch housing having an outer end;

(b) a pushbutton spring and a pushbutton displaceably supported in a switch on push direction and urged counter to the switching ON push direction by said pushbutton spring;

(c) a switch rod penetrating said switch housing at said outer and supporting said pushbutton;

(d) a contact bridge and a toggle lever device, comprising two levers joined pivotally at their inner ends disposed in said switch housing between said switch rod and said contact bridge;

(e) a detent lever and a detent pawl, a first said lever of said toggle lever device being oriented toward said switch rod and embodied as a bell crank, supported pivotally, substantially displaceable in the push direction of said switch rod, supported with a free arm counter to the switching ON push direction of said switch rod on said detent lever, adjustable by one of a thermal or electromagnetic trip, said toggle lever being spreadable into its stretching position from a switching ON push motion of said switch rod, and being flexible in a switching ON position at a substantially stretched toggle lever position by means of said detent pawl;

(f) a second said lever of said toggle lever remote from said switch rod having said contact bridge on its free end longitudinally guided in the push direction, a switching OFF spring inserted between said first lever and a counterpart bearing attached to said housing, such that said switching OFF spring is stressed in the switching ON position, and urges said toggle lever into its buckling direction and thus into a switching OFF direction;

(g) a second switch rod flanking said first switching rod parallel thereto, said second switch rod being guided displaceably in said switch housing in the push direction in common with said first switch rod, supported pivotally, in a plane parallel to the pivot plane of said toggle lever, between an engagement position and a release position, wherein said second switch rod, in the engagement position during a switching OFF push motion, pivots said detent lever for releasing said toggle lever and, in the release position during the switching ON push motion travels past said detent lever and is urged in the direction toward the engagement position, (h) said first lever having thereon a guide lever pivotally driven by said first lever and latchable to said second switch rod for pivoting said second switch rod during the switching ON push motion out of the engagement position into its release position, a counterpart bearing attached to said housing and supporting a support lever, as a detent pawl, both being pivotally supported.

2. An overload portion switch as defined by claim 1, further including a bearing pin disposed in the vicinity of its crank apex into first grooves of the switch housing and displaceably supported substantially in the push direction of said switch rods wherein said first lever is pivotable by means of said bearing pin, both said guide lever and said support lever being pivotally supported on said bearing pin.

3. An overload protection switch as defined by claim 1, wherein said switch rods are embodied by flat steel bars located one in the other hand and bent in an L shape in longitudinal section, and disposed with the flat plane of their vertical L legs parallel to the pivot plane of said toggle lever and which, standing on their head, engage the inside of a rectangular block-shaped recess of corresponding width on an inside of said pushbutton.

4. An overload protection switch as defined by claim 3, wherein said outer, first switch rod is secured with its horizontal L leg on the bottom of said pushbutton recess whereby, with the interposition of the horizontal L leg of said inner, second switch rod, said pushbutton spring is fastened in place between said counterpart bearing and the horizontal L legs, resting substantially parallel on one another of the switch rods.

5. An overload protection switch as defined by claim 3, wherein, with increasing distance from the horizontal L leg, the vertical L leg of said second switch rod has a continuously decreasing width.

6. An overload protection switch as defined by claim 5, wherein the horizontal L leg of said second switch rod is disposed with its plane of extension inclined in the transverse direction at a small, acute angle opening in the direction toward said detent lever, with respect to the plane of extension of the horizontal L leg of said first switch rod.

7. An overload protection switch as defined by claim 1, further including an additional trip lever arm on said detent lever wherein said second switch rod includes a lateral dog for actuation of said additional trip lever arm during its switching OFF push motion.

8. An overload protection switch as defined by claim 7, wherein said dog on said second switch rod is embodied as an integrally formed-on bending tab disposed in the vicinity of the free end of the vertical L leg of said switch rod, on a long side edge thereof oriented toward said detent lever and bent approximately at a right angle to the plane of extension of the vertical L leg.

9. An overload protection switch as defined by claim 3, wherein free end of the vertical L leg of said second switch rod tapers to an acute angle in the form of a latching protrusion cooperating with said guide lever.

10. An overload protection switch as defined by claim 1, further including a drive protrusion forming a part of said first lever of said toggle lever, wherein said guide lever comprises a two-armed lever disposed substantially in the push direction, the free end of said first lever arm of said guide lever oriented toward said pushbutton latching to the inner end of said second switch rod in the switching ON push motion, and the free end of said second lever arm oriented toward said contact bridge by contact of said drive protrusion of said first lever of said toggle lever is pivotally driven in the stretching direction of the toggle lever.

11. An overload protection switch as defined by claim 10, further including a bearing pin on said first lever of said toggle lever, wherein said guide lever comprises a T-shaped lever, the horizontal T leg of which forms said two lever arms and the vertical T end of which is pivotally supported on said bearing pin.

12. An overload protection switch as defined by claim 11, further including a guide face extending substantially in the push direction, wherein the horizontal T leg of said guide lever, in the switching OFF position of said switch latch, is contacted at a tangent to the outside thereof by said guide face, said guide face placing said guide lever into a defined outlet position with respect to the latching with said second switch rod, with said lever arms approximately parallel to the push direction.

13. An overload protection switch as defined by claim 1, said toggle lever having a bearing pin, wherein said support lever comprising a one-arm lever comprising two plates disposed parallel to one another and pivotally supported on both sides of said first lever of said toggle lever on said bearing pin and joined on their free ends by a pin, each of said plates having lateral notches on their free ends, said plates being supported by said notches, in the ON position, on said counterpart bearing attached to the housing and disposed on the side remote from said detent lever.

14. An overload protection switch as defined by claim 1, wherein said support lever, at least during the switching ON push motion, is pivotally urged in the direction toward said counterpart bearing.

15. An overload protection switch as defined by claim 14, further including a substantially diamond-shaped opening in the vertical L leg of said first switch rod, wherein said pin joining the free ends of said plates of said support lever extends through said diamond-shaped opening, an upper and a lower opposed peripheral edge of said opening extending approximately parallel to the push direction, the upper of the two other opposed peripheral edges inclined toward said counterpart bearing of said support lever, and, as a control straight edge upon the switching on push motion, displacing said pin and said support lever and via said bearing pin, said first lever of said toggle lever, in the switching ON direction and pivoting said pin of said support lever in the direction toward said counterpart bearing to support said support lever on said counterpart bearing, said lower peripheral edge being inclined in a direction away from said counterpart bearing and, as a stop edge cooperating with said pin, limiting the recoil motion of said switch rods and push button upon attainment of the ON position of said switch latch.

16. An overload protection switch as defined by claim 14, further including a torsion spring supported on said bearing pin for said first lever of said toggle lever, said lever with a second leg having a protrusion, said vertical L leg of said first switch rod having an opening, wherein said pin joining the free ends of said plates of said support lever with play, extends through said opening in the vertical L leg of said first switch rod, and is urged by spring action in the pivot direction toward said counterpart bearing by said leg of said torsion spring and supported on said protrusion, said first switch rod, in the vicinity of its inner end, having on a face end an inclined stop edge inclined toward said detent lever and cooperating in the switching ON push motion with said bearing pin of said first lever of said toggle lever.

17. An overload protection switch as defined by claim 1, wherein said counterpart bearing for supporting said support lever comprises a plate disposed with its plane at right angles to the push direction.

18. An overload protection switch as defined by claim 17, wherein said plate has an opening, said switching OFF spring being attached to said housing by a hanger eye suspended at an end of the switching OFF spring.

19. An overload protection switch as defined by claim 17, said counterpart bearing plate further including a guide recess on the side edge thereof oriented thereto, wherein the long side edge, oriented toward said counterpart bearing plate, of the vertical L leg of said first switch rod is guided in the push direction in said guide recess.

* * * * *